US006565461B1

(12) United States Patent
Zatlin

(10) Patent No.: US 6,565,461 B1
(45) Date of Patent: May 20, 2003

(54) METHOD AND APPARATUS FOR REDUCING THE LIKELIHOOD OF HEAD INJURY FROM HEADING A SOCCER BALL

(76) Inventor: Stuart E. Zatlin, 4542 Pershing Pl., St. Louis, MO (US) 63108

( * ) Notice: Subject to any disclaimer, the term of this patent is extended or adjusted under 35 U.S.C. 154(b) by 271 days.

(21) Appl. No.: 09/200,057

(22) Filed: Nov. 25, 1998

(51) Int. Cl.[7] ..... A63B 69/00
(52) U.S. Cl. ..... 473/446; 2/411; 473/458
(58) Field of Search ..... 473/446, 458, 473/422; 2/171, 411, 425

(56) References Cited

U.S. PATENT DOCUMENTS

| | | | | | |
|---|---|---|---|---|---|
| 1,163,247 | A | * | 12/1915 | McGrew | 2/414 |
| 1,698,769 | A | * | 1/1929 | Mullins | 2/425 |
| 1,886,551 | A | * | 11/1932 | Jones | 2/421 |
| 3,274,612 | A | * | 9/1966 | Merriam | 2/421 |
| 3,341,201 | A | * | 9/1967 | Ryan | 473/518 |
| 4,081,865 | A | * | 4/1978 | Bergee et al. | 2/425 |
| 4,462,590 | A | * | 7/1984 | Mitchell | 473/603 |
| 4,599,752 | A | | 7/1986 | Mitchell | |
| 4,698,852 | A | * | 10/1987 | Romero | 2/171 |
| 4,811,430 | A | * | 3/1989 | Janusz | 2/452 |
| 4,910,804 | A | * | 3/1990 | Lingren | 2/209.3 |
| 4,937,888 | A | | 7/1990 | Straus | |
| 4,947,488 | A | * | 8/1990 | Ashinoff | 2/181 |
| 5,111,366 | A | * | 5/1992 | Rife et al. | 362/31 |
| 5,525,290 | A | | 6/1996 | Carpenter | |
| 5,713,082 | A | | 2/1998 | Bassette et al. | |
| 5,718,245 | A | * | 2/1998 | Horn | 128/897 |
| 5,732,414 | A | | 3/1998 | Monica | |
| 5,745,923 | A | | 5/1998 | Katz | |
| D410,768 | S | | 6/1999 | Hirsh | |
| 5,930,841 | A | | 8/1999 | Lampe et al. | |
| 5,963,989 | A | * | 10/1999 | Robertson | 2/411 |
| 6,000,062 | A | * | 12/1999 | Trakh | 2/171 |

OTHER PUBLICATIONS

Mech Site Table of coefficients of friction –3 pages www.mech.f2s.com/friction/coefficient.htlm, Feb. 22, 2001.*

Soccer Docs/"Headers", Circa 1999.

Donald W. Rumbaugh, M.D., "The Head–R–Band", Circa 1999.

* cited by examiner

*Primary Examiner*—Paul T. Sewell
*Assistant Examiner*—M. Chambers
(74) *Attorney, Agent, or Firm*—Thompson Coburn LLP; Alan H. Norman

(57) ABSTRACT

A head protecting apparatus comprises a protective body, at least one cushioning member, and a friction member. The protective body is adapted to be worn on a soccer player's head. The body includes an interior portion adapted to fit against a portion of the player's head and an exterior portion adapted for impact with the soccer ball. The protective body includes a generally rigid guarding member adapted to cover at least a portion of the player's head when the player is wearing the protective body. The cushioning member is positioned between the guarding member and the player's head when the player is wearing the protective body. The cushioning member is adapted to absorb shock caused by impact between exterior portion of the protective body and the soccer ball when the player is heading the soccer ball. The friction member is mounted on the exterior portion of the protective body. The friction member includes an impact surface adapted for impact with the soccer ball. The friction member is adapted for frictional engagement with the soccer ball so as to facilitate the player's ability to control the direction of the soccer ball following impact.

6 Claims, 1 Drawing Sheet

METHOD AND APPARATUS FOR REDUCING THE LIKELIHOOD OF HEAD INJURY FROM HEADING A SOCCER BALL

BACKGROUND OF THE INVENTION

The present invention relates generally to methods and apparatus for reducing the likelihood of pain or injury from heading a soccer ball.

Soccer is the world's most popular sport, and its popularity within the United States is on the increase. This increase in soccer's popularity within the United States has lead to an increased awareness of potential soccer-related injuries, including head injuries. Soccer has been classified as a contact sport by the American Academy of Pediatrics, and injury surveillance studies have revealed that serious injuries of an acute or chronic nature do occur.

Playing soccer has the potential for head injury in two distinct ways. Injury can occur through major impact with another object (e.g., foot, head, elbow, knee, ground, goal post, etc.), that causes an acute injury. However, brain injury can also occur by the cumulative effect of multiple minor impacts on the head with the soccer ball itself.

"Heading" the soccer ball is an important part of the game of soccer. Generally, "heading" refers to the striking of the soccer ball with one's head to alter the path of the ball. Most typically, soccer players engage an airborne soccer ball with the forehead area (i.e., that part of the head just above the eyes, over the frontal bone). By facing or turning the head in one direction or another at the time of impact, the soccer players are able to re-direct the flight path of the soccer ball with the forehead.

Studies have revealed that repetitive, minor head impacts with the soccer ball (such as from heading the soccer ball) can, over time, lead to cumulative encephalopathy. Comparisons have been made between soccer and boxing with respect to a chronic brain syndrome similar to the brain damage experienced by some professional boxers. Millions of children in this country begin playing soccer at a very early age, and many will continue to play well in to adulthood. These players carry a significant lifetime risk of developing a chronic head injury due to the cumulative effect of multiple minor impacts on the head with the soccer ball.

SUMMARY OF THE INVENTION

The present invention pertains to methods and apparatus for reducing the likelihood of acute or chronic head injury from playing soccer. An object of the invention is to provide an apparatus that can be worn by a soccer player to reduce the likelihood of head injury from impact with another object by absorbing and disbursing shock caused by the impact between a soccer player's head and the object. Another object of the invention is to provide an apparatus that can worn by the soccer player to reduce the likelihood of head injury do to repetitive, minor head impacts with the soccer ball without compromising the soccer player's ability to control the direction of the soccer ball while heading the soccer ball. A further object of the invention is to provide a method of heading a soccer ball, which reduces the likelihood of head injury from heading the soccer ball.

In general, head protecting apparatus of the present invention comprises a protective body, at least one cushioning member, and a friction member. The protective body is adapted to be worn on a soccer player's head. The body includes an interior portion adapted to fit against a portion of the player's head and an exterior portion adapted for impact with the soccer ball. The protective body includes a generally rigid guarding member adapted to cover at least a portion of the player's head when the player is wearing the protective body. The cushioning member is positioned between the guarding member and the player's head when the player is wearing the protective body. The cushioning member is adapted to absorb shock caused by impact between exterior portion of the protective body and the soccer ball when the player is heading the soccer ball. The friction member is mounted on the exterior portion of the guarding member. The friction member includes an impact surface adapted for impact with the soccer ball. The friction member is adapted for frictional engagement with the soccer ball so as to facilitate the player's ability to control the direction of the soccer ball following impact.

In another aspect of the invention, a method comprises the steps of providing a protective body, wearing the protective body, and heading the soccer ball. The protective body is adapted to be worn on a soccer player's head. The protective body has an interior portion adapted to fit against a portion of the player's head and an exterior portion adapted for impact with the soccer ball. The protective body is worn by positioning the interior portion of the protective body against the portion of the player's head so as to reduce the likelihood of head injury from heading the soccer ball. Heading the soccer ball is accomplished in a manner so that the exterior portion of the protective body impacts with the soccer ball while the player is wearing the protective body.

A further aspect of the invention involves a protective head gear kit comprising a protective body and a media embodying element. The protective body is adapted to be worn on a soccer player's head. The body has an interior portion adapted to fit against a portion of the player's head and an exterior portion adapted for impact with a soccer ball. The protective body includes a generally rigid guarding member adapted to cover at least a portion of the player's head when the player is wearing the protective body. The media embodying element includes media that conveys information indicating that the protective body can be used to help in reducing the likelihood for head injury from heading the soccer ball. The media conveys information indicating that the protective body is to be worn on a soccer player's head in a manner so that the protective body impacts the ball as the player heads the ball. The protective body and the media embodying element are packaged together.

Other advantages and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
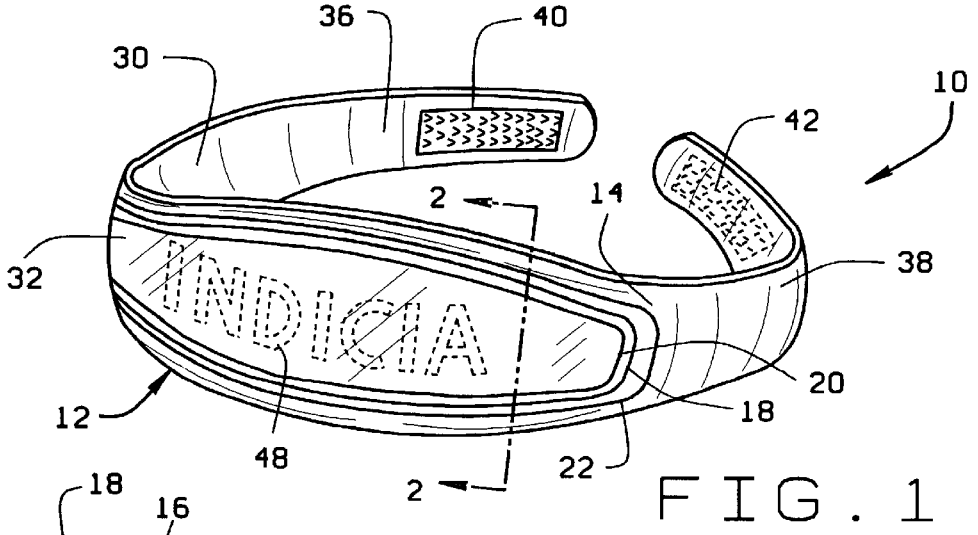
FIG. 1 is a perspective view of a head protecting apparatus of the present invention.

A head protecting apparatus of the present invention is represented generally in FIG. 1 by the reference numeral 10.

As explained below, the apparatus 10 is configured to be worn by a soccer player on the player's head and is adapted for reducing the likelihood of head injury from heading a soccer ball.

Figure 2:
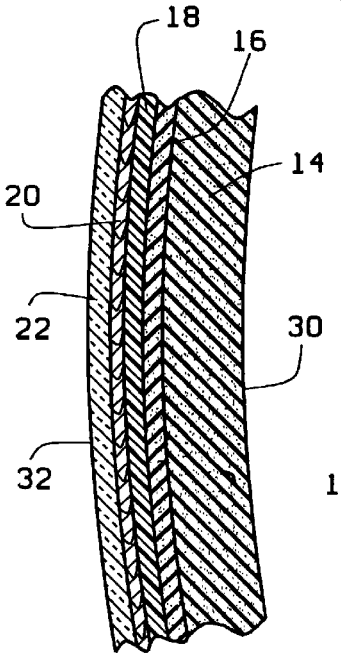
FIG. 2 is a cross-sectional view of the head protecting apparatus of FIG. 1 taken along the plane of line 2—2 in FIG. 1.

FIG. 2 is a cross-sectional view of a portion of the head protecting apparatus 10, taken along the plane of line 2—2 in FIG. 1, showing the component parts of the preferred embodiment. The apparatus 10 comprises a protective body 12, which is preferably constructed as a laminate comprised of several layers of material. As shown in FIG. 2, the protective body 12 preferably includes a first foam body 14, a second foam body 16, a generally rigid guarding member 18, and an indicia bearing member 20, and a friction member 22. These layers preferably extend across the protective body 12.

The protective body 12 is adapted to be worn on the soccer player's head. The body 12 includes an interior portion 30 adapted to fit against a portion of the player's head and an exterior portion 32 adapted for impact with the soccer ball. The protective body 12 is configured so that the first foam body 14, second foam body 16, guarding member 18, and friction member 22 lie over the player's forehead, preferably over the player's frontal bone.

As shown in FIG. 1, the protective body 12 includes a pair of head-circumscribing members 36 and 38 extending from the protective body. The head-circumscribing members 36 and 38 are adapted to at least partially circumscribe the player's head in a manner for securing the protective body 12 in place with the interior portion 30 of the protective body 12 against the player's head. The head-circumscribing members 36 and 38 include fastening members at their distal ends for fastening the distal ends of the head-circumscribing members 36 and 38 to one another to secure the protective body 12 to the soccer player's head. Preferably, the fastening members are comprised of a hook component 40 and a loop component 42, such as VELCRO®, although other suitable fasteners could be employed for fastening the distal ends of the head-circumscribing members 36 and 38 to one another without departing from the scope of the invention. Thus, in use, the protective body 12 is positioned on the soccer player's head proximate the player's frontal bone, with the head-circumscribing members 36 and 38 wrapped around the player's head and fastened to one another at the back of the player's head.

Preferably, the first foam body 14 is formed from polyurethane foam having a thickness of about 0.2" and the second foam body 16 is formed from ethylene vinyl acetate (EVA) foam having a thickness of about 0.2". Each of these materials serves as a cushioning material that absorbs shock due to impact between the soccer player's head and the soccer ball when the soccer player is heading the soccer ball. The preferred thickness of about 0.2" for these layers allows a sufficient amount of cushioning without comprising the flexibility and comfort of the apparatus as a whole. The first foam body 14 may also be sandwiched between two thin layers of polyester knit fabric (not shown) to improve the comfort and aesthetics of the apparatus. The polyester knit fabric also serves to protect the first foam body 14 from wear and, thus, prolongs the life of the apparatus. Although urethane foam and EVA foam are the preferred materials for these components, it should be understood that other materials having similar cushioning characteristics could be used without departing from the scope of the present invention.

The generally rigid guarding member 18 is preferably formed from PVC having a thickness of about 0.03". The guarding member 18 accepts the impact from the soccer ball when the player is heading the soccer ball and, together with the first and second foam bodies 14 and 16, absorbs and disburses shock caused by the impact between a soccer player's head and the ball. The preferred thickness of about 0.03" for the guarding member 18 provides a sufficient amount of protection while remaining sufficiently flexible so that the protective body 12 as a whole can fit comfortably around the soccer player's head. Although PVC is the preferred material for the guarding member, it should be understood that other polymeric and nonpolymeric materials having similar mechanical characteristics could be used without departing from the scope of the present invention.

The friction member 22 is on the exterior portion 32 of the protective body 12. The friction member 22 includes an impact surface 34 adapted for impact with the soccer ball. The friction member 22 is adapted for a frictional engagement with the soccer ball so as to facilitate the player's ability to control the direction of the soccer ball following impact. Preferably, the friction member is formed from a soft vinyl material having a thickness of about 0.04". The soft vinyl material has a relatively high coefficient of friction and is adapted for a frictional engagement with the soccer ball when the player is heading the ball. Preferably, the friction member 22 has a higher coefficient of friction than the guarding member 18. Although the preferred material for the friction member is vinyl, other materials exhibiting similar characteristics could be used without departing from the scope of the invention.

The relatively high friction characteristics of the friction member 22 facilitate the player's ability to control the direction of the soccer ball following impact. In general, most impacts between the soccer player's head and the soccer ball will be "oblique impacts." The imaginary line passing through the mass centers of two colliding objects is referred to as the line of impact. An "oblique impact" occurs when the motion of one or both of the objects is at an angle with the line of impact. The high friction characteristics of the friction member 22 makes "glancing" deflections of the soccer ball less likely, even under an oblique impact. The friction member 22 tends to "grip" the surface of the soccer ball at impact, and thereby facilitates the player's ability to control the direction of the soccer ball following impact.

As shown in FIG. 1, the friction member 22 is preferably an enclosure, the edges of which are bonded to the exterior surface of the first foam body 14. Thus, the friction member 22, together with the first foam body 14, form an enclosure enclosing the second foam body 16 and the guarding member 18.

As shown in FIGS. 1 and 2, the protective body may include an indicia bearing member 20 between the friction member 22 and the guarding member 18. In embodiments including the indicia bearing member 20, the friction member 22 is preferably substantially transparent so as to allow indicia 48 on the indicia bearing member 20 to be viewed through the friction member 22.

A method of the present invention comprises the steps of providing a protective body similar to the protective body 12 described above, wearing the protective body 12 on the head, and heading the soccer ball while wearing the protective body 12. The protective body 12 is worn by positioning the interior portion 30 of the protective body 12 against the player's head proximate the player's frontal bone so as to reduce the likelihood of head injury from heading the soccer ball. Heading the soccer ball is accomplished in a manner so that the exterior portion 32 of the protective body 12 impacts with the soccer ball while the player is wearing the protective body 12 in the manner described above.

Figure 3:
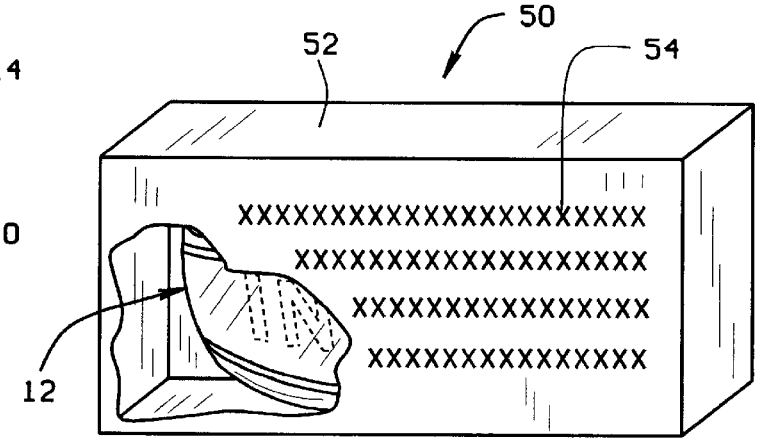
FIG. 3 is a perspective view of a protective head gear kit with a portion of a media embodying element broken away to show its contents.

A further aspect of the present invention shown in FIG. 3 is a protective head gear kit 50. The kit 50 comprises a protective body 12 as described above and a media embodying element 52. The media embodying element 52 preferably includes media 54 that conveys information indicating that the protective body 12 can be worn to reduce the likelihood of head injury from heading a soccer ball. The media 54 also preferably conveys information indicating that the protective body 12 is to be worn in a manner so that the exterior portion 32 of the protective body 12 impacts with the soccer ball when the player is heading the soccer ball. The protective body 12 and the media embodying element 50 are packaged together. As shown in FIG. 3, the media embodying element 52 is preferably a box or carton having an interior that is sized to contain the protective body 12. Preferably, the media 54 is in the form of printed text on an exterior of the box or carton. However, other types of media embodying elements 52 and other forms of media 54 could be employed without departing from the scope of the invention. For example, the media embodying element could comprise a generally two-dimensional sheet or card with textual or graphical media printed thereon that conveys the above information, and the sheet or card could be tethered to or otherwise secured to the protective body.

Figure 4:
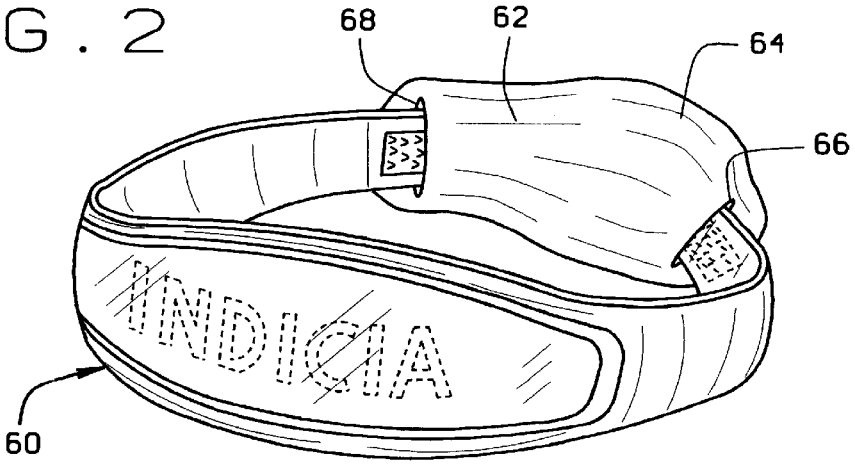
FIG. 4 is a perspective view of another embodiment of a head protecting apparatus of the present invention.

FIG. 4 shows another embodiment of the present invention. A protective body is represented generally by the reference numeral 60. The protective body 60 is substantially the same as the protective body 12 described above, but further comprises a rear portion 62. The rear portion 62 is preferably made from the same materials as the first foam body 14 of the protective body 12 described above. The rear portion 62 is adapted for reducing the likelihood of head injury due to impacts between a back portion of the soccer player's and another object (e.g., an elbow, a goal post, the ground, etc.). As shown in FIG. 4, the rear portion 62 preferably includes a widened portion 64 that is adapted to cover the back portion of the soccer player's head. The widened portion 64 also provides a larger area to put indicia, such as a brand logo, on the back of the protective body 60. Also, the rear portion 62 preferably includes a pair of slots 66 and 68 sized to receive head-circumscribing members 70 and 72. The rear portion 62 is preferably fastened to the head-circumscribing members 70 and 72 of the protective body 60 with hook and loop fasteners 74, such as VELCRO®.

In the preferred embodiments of the invention discussed above, the protective body 12 is a head band adapted to cover at least a portion of the soccer player's forehead. However, other configurations could be employed without departing from the scope of the invention. For example, in an alternative embodiment, the protective body may include an upper portion extending from the forehead area rearwardly toward to the back of the head in a manner to cover a portion of the top of the soccer player's head. In still another alternative embodiment, the protective body may include portions that extend over the ears or nose of the soccer player to reduce the likelihood of injury to those areas.

In view of the above, it will be seen that the present invention overcomes problems associated with the prior art and achieves other advantageous results. As various changes could be made without departing the scope of the invention, it is intended that all matter contained in the above description or shown in accompanying drawings shall be interpreted as illustrative and not in a limiting sense.

What is claimed is:

1. A method of heading a soccer ball comprising:

providing a head-protecting apparatus adapted to reduce the likelihood of head injury from heading a soccer ball, the apparatus comprising a protective body, at least one cushioning member, and a friction member, the protective body being adapted to be worn on the soccer player's head, the body having an interior portion adapted to fit against a portion of the player's head and an exterior portion adapted for impact with the soccer ball, the protective body including a generally rigid guarding member adapted to cover at least a portion of the player's head when the player is wearing the protective body, the at least one cushioning member being positioned between the guarding member and the player's head when the player is wearing the protective body, the at least one cushioning member being adapted to absorb shock caused by impact between the exterior portion of the protective body and the soccer ball when the player is heading the soccer ball, the friction member being mounted on the exterior portion of the protective body, the friction member having an impact surface adapted for impact with the soccer ball, the friction member having a first coefficient of friction and the guarding member having a second coefficient of friction, the first coefficient of friction being greater than the second coefficient of friction, the friction member being adapted for frictional engagement with the soccer ball so as to facilitate the player's ability to control a direction of the soccer ball after impact;

wearing the head-protecting apparatus by positioning the interior portion of the protective body against the portion of the player's head in a manner so that at least a portion of the guarding member is positioned over at least a portion of the player's frontal bone; and heading the soccer ball in a manner so that the impact surface of the friction member impacts with the soccer ball while performing the step of wearing the head-protecting apparatus.

2. A method of heading a soccer ball comprising:

providing a head-protecting apparatus adapted to reduce the likelihood of head injury from heading a soccer ball, the apparatus comprising a protective body, at least one cushioning member, and a friction member, the protective body being adapted to be worn on the soccer player's head, the body having an interior portion adapted to fit against a portion of the player's head and an exterior portion adapted for impact with the soccer ball, the protective body including a generally rigid guarding member adapted to cover at least a portion of the player's head when the player is wearing the protective body, the at least one cushioning member being positioned between the guarding member and the player's head when the player is wearing the protective body, the at least one cushioning member being adapted to absorb shock caused by impact between the exterior portion of the protective body and the soccer ball when the player is heading the soccer ball, the friction member being mounted on the exterior portion of the protective body, the friction member having an impact surface adapted for impact with the soccer ball, the friction member having a first coefficient of friction and the guarding member having a second coefficient of friction, the first coefficient of friction being greater than the second coefficient of friction, the friction member being adapted for frictional engagement with the soccer ball so as to facilitate the player's ability to control a direction of the soccer ball after impact;

removing the head-protecting apparatus from a package having a media embodying element including media that conveys information indicating that the head-protecting apparatus is to be worn a manner so that the head-protecting apparatus impacts the ball as the player heads the ball;

wearing the head-protecting apparatus; and heading the soccer ball in a manner so that the head-protecting apparatus impacts the soccer ball.

3. A method of heading a soccer ball comprising the steps of:

providing a head-protecting apparatus comprising a protective body and a friction member, the protective body being adapted to be worn on a soccer player's head, the protective body having an interior portion adapted to fit against a portion of the player's head and an exterior portion adapted for impact with the soccer ball, the protective body including a generally rigid guarding member adapted to cover at least a portion of the player's head when the player is wearing the protective body, the friction member being mounted on the exterior portion of the protective body, the friction member having an impact surface adapted for impact with the soccer ball, the friction member having a first coefficient of friction and the guarding member having a second coefficient of friction, the first coefficient of friction being greater than the second coefficient of friction;

wearing the head-protecting apparatus by positioning the interior portion of the protective body against the portion of the player's head in a manner so that at least a portion of the guarding member is positioned over at least a portion of the player's frontal bone; and heading the soccer ball in a manner so that the impact surface of the friction member impacts with the soccer ball while performing the step of wearing the head-protecting apparatus;

the step of providing the head-protecting apparatus further comprises providing an indicia bearing member between the friction member and the guarding member, the friction member being substantially transparent so as to allow indicia on the indicia bearing member to be viewed through the friction member.

4. A method of heading a soccer ball comprising the steps of:

providing a head-protecting apparatus comprising a protective body and a friction member, the protective body being adapted to be worn on a soccer player's head, the protective body having an interior portion adapted to fit against a portion of the player's head and an exterior portion adapted for impact with the soccer ball, the protective body including a generally rigid guarding member adapted to cover at least a portion of the player's head when the player is wearing the protective body, the friction member being mounted on the exterior portion of the protective body, the friction member having an impact surface adapted for impact with the soccer ball, the friction member having a first coefficient of friction and the guarding member having a second coefficient of friction, the first coefficient of friction being greater than the second coefficient of friction;

providing the protective body with at least one head-circumscribing member connected to the protective body, the head circumscribing member being adapted to at least partially circumscribe the player's head in a manner for securing the protective body in place with the interior portion of the protective body against the players head wearing the head-protecting apparatus by positioning the interior portion of the protective body against the portion of the player's head in a manner so that at least a portion of the guarding member is positioned over at least a portion of the player's frontal bone; and heading the soccer ball in a manner so that the impact surface of the friction member impacts with the soccer ball while performing the step of wearing the head-protecting apparatus.

5. A method of heading a soccer ball comprising the steps of:

providing a head-protecting apparatus comprising a protective body and a friction member, the protective body being adapted to be worn on a soccer players head, the protective body having an interior portion adapted to fit against a portion of the player's head and an exterior portion adapted for impact with the soccer ball, the protective body including a generally rigid guarding member adapted to cover at least a portion of the player's head when the player is wearing the protective body, the protective body being a head band adapted to cover at least a portion of the soccer player's frontal bone, the friction member being mounted on the exterior portion of the protective body, the friction member having an impact surface adapted for impact with the soccer ball, the friction member having a first coefficient of friction and the guarding member having a second coefficient of friction, the first coefficient of friction being greater than the second coefficient of friction;

wearing the head-protecting apparatus by positioning the interior portion of the protective body against the portion of the players head in a manner so that at least a portion of the guarding member is positioned over at least a portion of the player's frontal bone; and heading the soccer ball in a manner so that the impact surface of the friction member impacts with the soccer ball while performing the step of wearing the head-protecting apparatus;

the step of positioning the interior portion of the protective body against the soccer player's head includes the step of positioning the head band on the soccer player's head proximate the frontal bone so as to reduce the likelihood of head injury from heading the soccer ball.

6. A method of heading a soccer ball comprising the steps of:

providing a head-protecting apparatus comprising a protective body and a friction member, the protective body being adapted to be worn on a soccer player's head, the protective body having an interior portion adapted to fit against a portion of the player's head and an exterior portion adapted for impact with the soccer ball, the protective body including a generally rigid guarding member adapted to cover at least a portion of the player's head when the player is wearing the protective body, the friction member being mounted on the exterior portion of the protective body, the friction member having an impact surface adapted for impact with the soccer ball, the friction member having a first coefficient of friction and the guarding member having a second coefficient of friction, the first coefficient of friction being greater than the second coefficient of friction;

wearing the head-protecting apparatus by positioning the interior portion of the protective body against the portion of the player's head in a manner so that at least a portion of the guarding member is positioned over at least a portion of the player's frontal bone;

heading the soccer ball in a manner so that the impact surface of the friction member impacts with the soccer ball while performing the step of wearing the head-protecting apparatus; and heading the soccer ball in a manner so that the exterior portion of the protective body impacts with the soccer ball.

* * * * *